US007926786B2

(12) United States Patent
Slagle

(10) Patent No.: US 7,926,786 B2
(45) Date of Patent: Apr. 19, 2011

(54) POST PULLER

(75) Inventor: Mark Slagle, Sargent, NE (US)

(73) Assignee: BAC Industries, Inc., Eagle Bend, MN (US)

( * ) Notice: Subject to any disclaimer, the term of this patent is extended or adjusted under 35 U.S.C. 154(b) by 161 days.

(21) Appl. No.: 12/142,304

(22) Filed: Jun. 19, 2008

(65) Prior Publication Data

US 2009/0315003 A1 Dec. 24, 2009

(51) Int. Cl.
*E21B 19/04* (2006.01)

(52) U.S. Cl. ..... 254/30; 254/29 R

(58) Field of Classification Search ..... 254/30, 254/131, 29 R, 132
See application file for complete search history.

(56) References Cited

U.S. PATENT DOCUMENTS

| | | | | |
|---|---|---|---|---|
| 1,452,205 | A | 4/1923 | Madsen | |
| 1,543,123 | A | 6/1925 | Renari | |
| 2,482,950 | A * | 9/1949 | Toftey | 254/30 |
| 3,549,126 | A * | 12/1970 | Devries | 254/132 |
| 3,647,185 | A | 3/1972 | Phibbs | |
| 4,026,522 | A * | 5/1977 | Dranselka | 254/30 |
| 4,822,006 | A | 4/1989 | McIntire | |
| 5,211,374 | A | 5/1993 | Head et al. | |
| 5,242,152 | A * | 9/1993 | Schatz | 254/30 |
| 6,056,271 | A * | 5/2000 | Riojas | 254/30 |
| 7,204,535 | B2 | 4/2007 | Hansen | |
| 2009/0315003 | A1 * | 12/2009 | Slagle | 254/30 |

* cited by examiner

*Primary Examiner* — Lee D Wilson
(74) *Attorney, Agent, or Firm* — Thomas J. Nikolai; Nikolai & Mersereau, P.A.

(57) ABSTRACT

In some embodiments, a post puller may include one or more of the following features: (a) a frame capable of being coupled to a vehicle, (b) first and second post removal doors having an open side facing each other and an opposite end coupled to the frame, (c) a V-shaped opening located on the open side of the doors, (d) butt hinges along which couple the doors to the frame along a hinge axis, (e) a blade located on the open side of each door, and (f) a fork aperture for receiving a fork.

9 Claims, 2 Drawing Sheets

POST PULLER

BACKGROUND OF THE INVENTION

I. Field of the Invention

Embodiments of the present invention relate to devices for removing materials from the ground. Particularly, embodiments of the present invention relate to post pullers. More particularly, embodiments of the present invention relate to post pullers operated by and/or controlled by powered vehicles.

II. Discussion of Related Art

There are countless applications for a grasping and lifting apparatus for heavy or awkward work pieces. One example is a post puller grasping an elongated object such as a fence post or a telephone pole and lifting it out of a post hole or positioning it in a post hole or simply moving it about from place to place. A typical post puller consists of some type of clamp attached to a machine with lifting power, for example a tractor or a skid-steer loader. The clamp may be nothing more complex than a length of heavy chain wrapped tightly around the post, securing the post to the lifting machine. Such a clamp enables a remotely located worker such as a farmer with no power machinery other than a tractor to use the power lifting capacity of the tractor to place and remove fence posts or other awkward or heavy objects including brush and trees.

A chain used as a clamp may require a person to hold the chain securely around the post during the lifting and moving operation. If the chain is attached to a tractor with lifting capability, it may be possible for one person to simultaneously hold the chain and operate the tractor, but at best this is clumsy, and it often poses safety issues, so a second person may be needed. Lifting machines such as tractors or skid-steer loaders generally lift by pivoting about a point, and this results in the lifting motion being arcuate rather than linear. When inserting a post into, or removing it from, a deep post hole, an arcuate lifting motion can cause the post to bind against the walls of the hole, damaging the hole or the post, or rendering the lifting operation impossible.

Accordingly, there has been a need for a lifting apparatus easily attached to a lifting machine in a remote location, safely and conveniently operated by a sole worker, and can lift clumsy or heavy objects. It would be desirable for such an apparatus to lift an object through a linear rather than an arcuate range of motion.

SUMMARY OF THE INVENTION

In some embodiments, an apparatus for pulling posts may include one or more of the following features: (a) a frame having a first fork aperture and a second fork aperture coupled by a support member, (b) a first post removal door coupled to the first fork aperture and a second post removal door coupled to the second fork aperture, the doors coupled with a butt hinge, (c) a V-shaped opening on an end opposite the support member, and (d) a blade coupled to the first post removal door.

In some embodiments, a method of removing a post may include one or more of the following steps: (a) positioning a post puller, having fork apertures coupled together by a support member, around a post, (b) elevating the post puller to pinch the post between post removal doors, (c) pulling the post from the ground, (d) coupling the post puller to a vehicle, (e) transporting the post puller to the post, (f) driving the vehicle to a drop location, (g) lowering the post puller, and (h) releasing the post.

In some embodiments, a post puller may include one or more of the following features: (a) a frame capable of being coupled to a vehicle, (b) a first and second post removal doors having an open side facing each other and an opposite end coupled to the frame, (c) a V-shaped opening located on the open side of the doors, (d) butt hinges along which couple the doors to the frame along a hinge axis, (e) a blade located on the open side of each door, and (f) a fork aperture for receiving a fork.

DESCRIPTION OF PREFERRED EMBODIMENT

Figure 1:
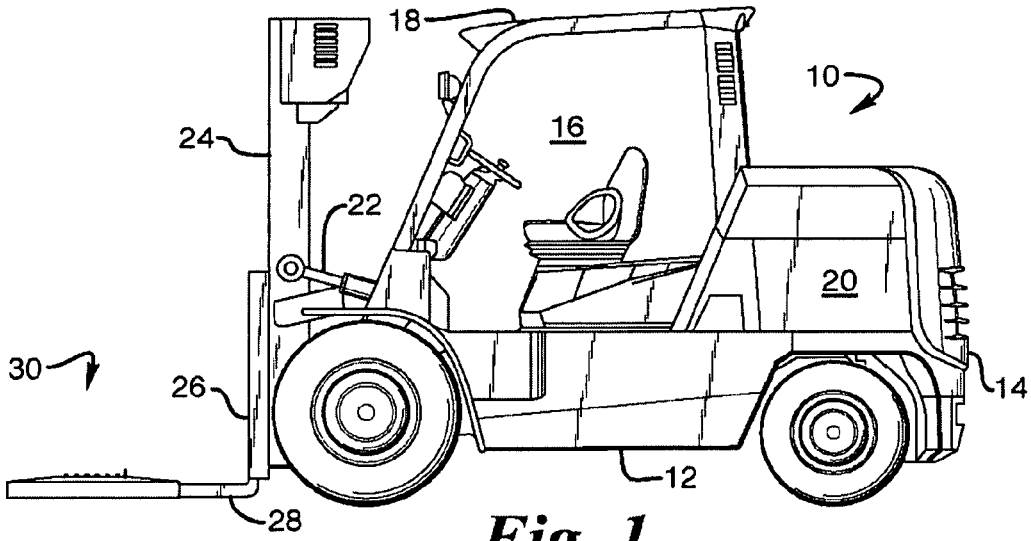
FIG. 1 shows a side profile of a forklift as in embodiments of the present invention.

The following discussion is presented to enable a person skilled in the art to make and use the present teachings. Various modifications to the illustrated embodiments will be readily apparent to those skilled in the art, and the generic principles herein may be applied to other embodiments and applications without departing from the present teachings. Thus, the present teachings are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the present teachings. Skilled artisans will recognize the examples provided herein have many useful alternatives and fall within the scope of the present teachings.

In embodiments of the present invention, a post puller can mount on a skid loader, a three-point hitch on a tractor, a tractor front end loader, an industrial wheel loader and a fork lift. The post puller operates by allowing an operator to place the post puller around a post or tree. The jaws of the post puller swing upward (depending on the size of the post or tree) as the post or tree push against the jaws to accommodate the post or tree. When the post or tree is in the post puller, the operator would then raise the post puller upward. As the post puller rises, the jaws of post puller pinch together, "bite into the post". By raising the post puller upward the post or tree is pulled from the ground. To release the post or tree, the operator would simply lower the post puller until the post or tree hit the ground, which would push upward on the jaws, thus opening the jaws and releasing the post or tree.

As stated above, embodiments of the present invention can incorporate a skid loader. A skid loader or skid-steer loader is a rigid frame, engine-powered machine with lift arms used to attach a wide variety of labor-saving tools or attachments. Skid-steer loaders are four-wheel drive vehicles with the left-side drive wheels independent of the right-side drive wheels. By having each side independent of the other, wheel speed and direction of rotation of the wheels determine the direction the loader will turn. Skid-steer loaders can turn in their own tracks which make them extremely maneuverable and valuable for applications requiring a compact, agile loader. Unlike conventional front loaders, the lift arms in these machines are alongside the driver with the pivot points behind the driver's shoulders. Because of the operator's proximity to moving booms, early skid loaders were not as safe as conventional front loaders, particularly during entry and exit of the operator. Modern skid loaders have fully-enclosed cabs and other features to protect the operator. Like other front loaders, it can push material from one location to another, carry material in its bucket or load material into a truck or trailer. Most owners of skid steer loaders have a fork lift attachment also, making the post-puller easy to mount.

Embodiments of the present invention can incorporate a three-point hitch. The three-point hitch is made up of several components working together. These include the tractor's hydraulic system, attaching points, the lifting arms, and stabilizers. Three-point hitches are composed of three movable arms. The two outer arms—the hitch lifting arms—are controlled by the hydraulic system, and provide lifting, lowering, and even tilting to the arms. The center arm—called the top link—is movable, but is usually not powered by the tractor's hydraulic system. Each arm has an attachment device to connect implements to the hitch. Each hitch has attachment holes for attaching implements, and the implement has posts fitting through the holes. The implement is secured by placing a pin on the ends of the posts. The hitch lifting arms are powered by the tractor's own hydraulic system. The hydraulic system is controlled by the operator, and usually a variety of settings are available. There are several different hitch systems, called categories. Category Zero hitches are used with small farm or garden tractors. Category III hitches are found on the larger farm tractors, or those above 90 hp. The primary benefit of the three-point hitch system is to transfer the weight and stress of an implement to the rear wheels of a tractor.

With reference to FIG. 1, a side profile of a forklift 10 as in embodiments of the present invention is shown. Forklift 10 is used for the discussion below in regards to the post puller for ease of understanding by the reader. However, most any vehicle which projects force upwards, such as a skid loader or a three-point hitch, can be used without departing from the spirit of the invention.

A forklift 10 can have a frame 12 which is the base of forklift 10 to which the mast, axles, wheels, counterweight, overhead guard and power source are attached. Frame 12 may have fuel and hydraulic fluid tanks constructed as part of the frame assembly. A counterweight 14 is a heavy cast iron mass attached to the rear of the forklift frame 12. The purpose of counterweight 14 is to counterbalance the load being lifted. In an electric forklift 10 the large lead-acid battery itself may serve as part of the counterweight. Cab 16 is the area containing a seat for the operator along with the control pedals, steering wheel, levers, switches, and a dashboard containing operator readouts. Cab 16 may be open air or enclosed, but it is covered by cage-like overhead guard assembly 18. Overhead guard 18 is a metal roof supported by posts at each corner of cab 16 helping protect the operator from any falling objects. On some forklifts 10, overhead guard 18 is part of frame assembly 12. Power source 20 may consist of an internal combustion engine powered by LP gas, CNG gas, gasoline or diesel fuel. Electric forklifts 10 are powered by either a battery or fuel cells providing power to electric motors. The motors may be either DC or AC types. Tilt cylinders 22 are hydraulic cylinders mounted to the frame 12 and the mast 24. Tilt cylinders 22 pivot the mast 24 to assist in engaging a load.

Mast 24 is the vertical assembly raising and lowering the load. It is made up of interlocking rails providing lateral stability. The interlocking rails may either have rollers or bushings as guides. Mast 24 is either hydraulically operated by one or more hydraulic cylinders or it may be chain operated with a hydraulic motor providing motive power. It may be mounted to the front axle or frame 12 of forklift 10. Carriage 26 is the component to which forks 28 or other attachments mount. Carriage 26 is mounted into and moves up and down the mast rails by means of chains or by being directly attached to the hydraulic cylinder. Like mast 24, carriage 26 may have either rollers or bushings to guide it in the interlocking mast rails.

Figure 2:
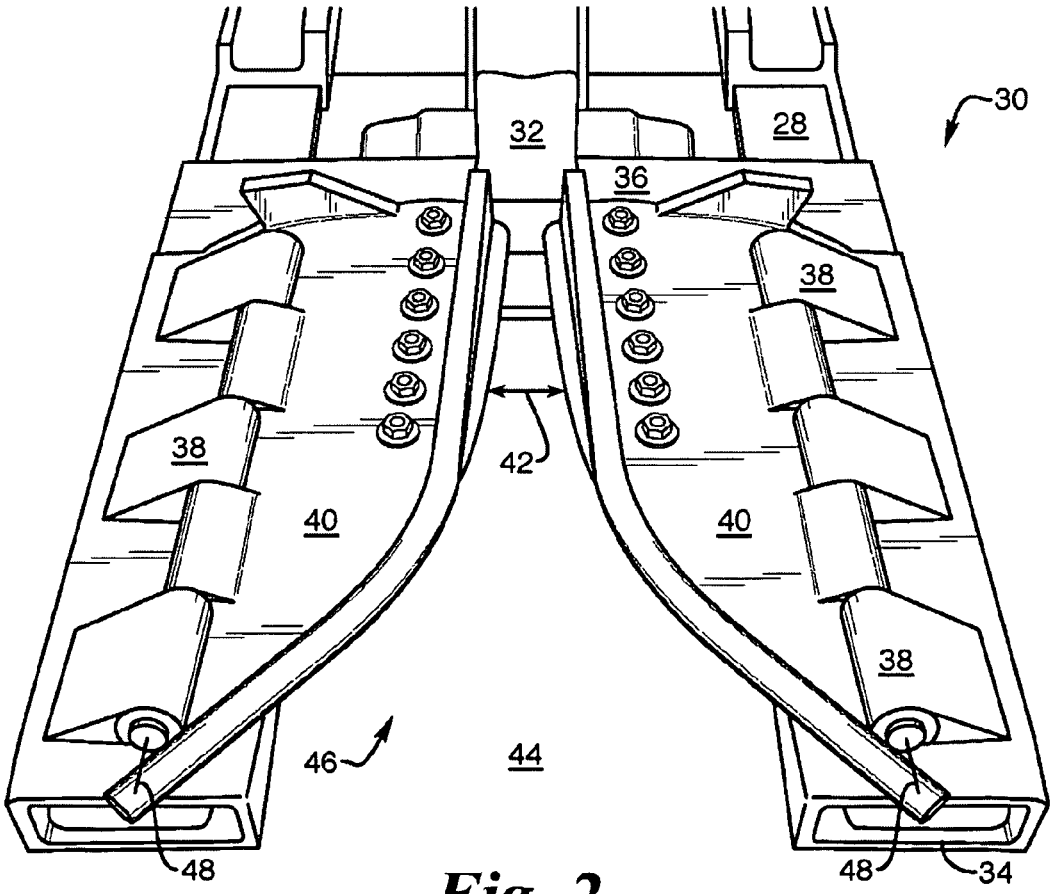
FIG. 2 shows a front elevated profile view of a post puller coupled to a forklift in an embodiment of the present invention.

With reference to FIG. 2, a front elevated profile view of a post puller coupled to a forklift in an embodiment of the present invention is shown. Post puller 30 is shown coupled to forks 28 of forklift 10. Post puller 30 has a frame 32 with a pair of fork apertures 34 coupled by a tractor side support member 36. Coupled by butt hinges 38 to fork apertures 34 are post removal doors 40. Located on the interior of post removal doors 40 are metal blades 42. Removal doors 40 present a V-shaped opening 44 at an opposite end 46 from support member 36. V-shaped opening 44 allows for posts to be directed towards blades 42 should the operator not center the post within post puller 30 exactly. Post puller 30 is shown made of steel, however, it is fully contemplated post puller 30 could be made from most any material, such as iron, stainless steel, and plastic, without departing from the spirit of the invention.

Figure 3:
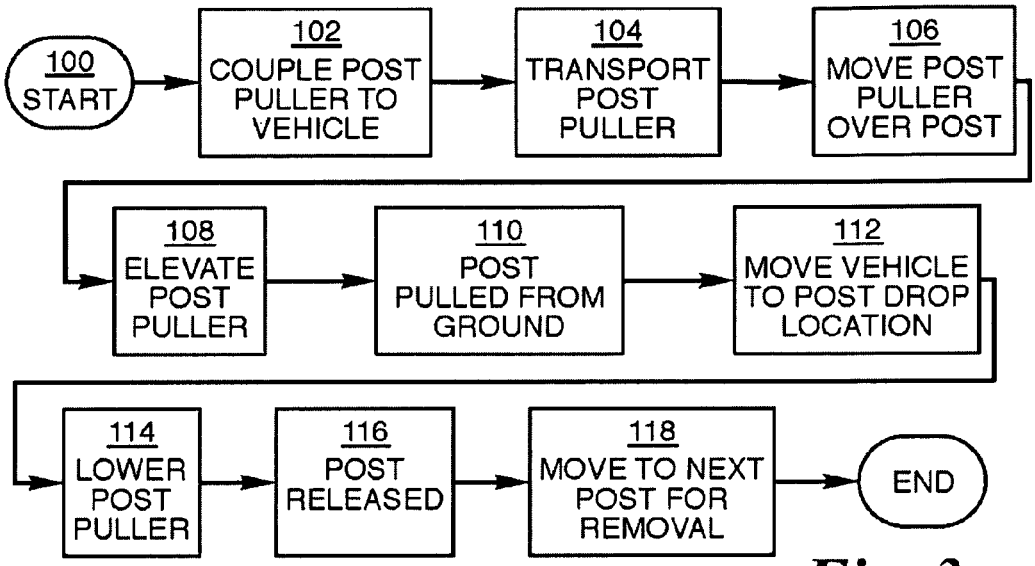
FIG. 3 shows a flow process diagram of the operation of a post puller in an embodiment of the present invention.
Figure 4:
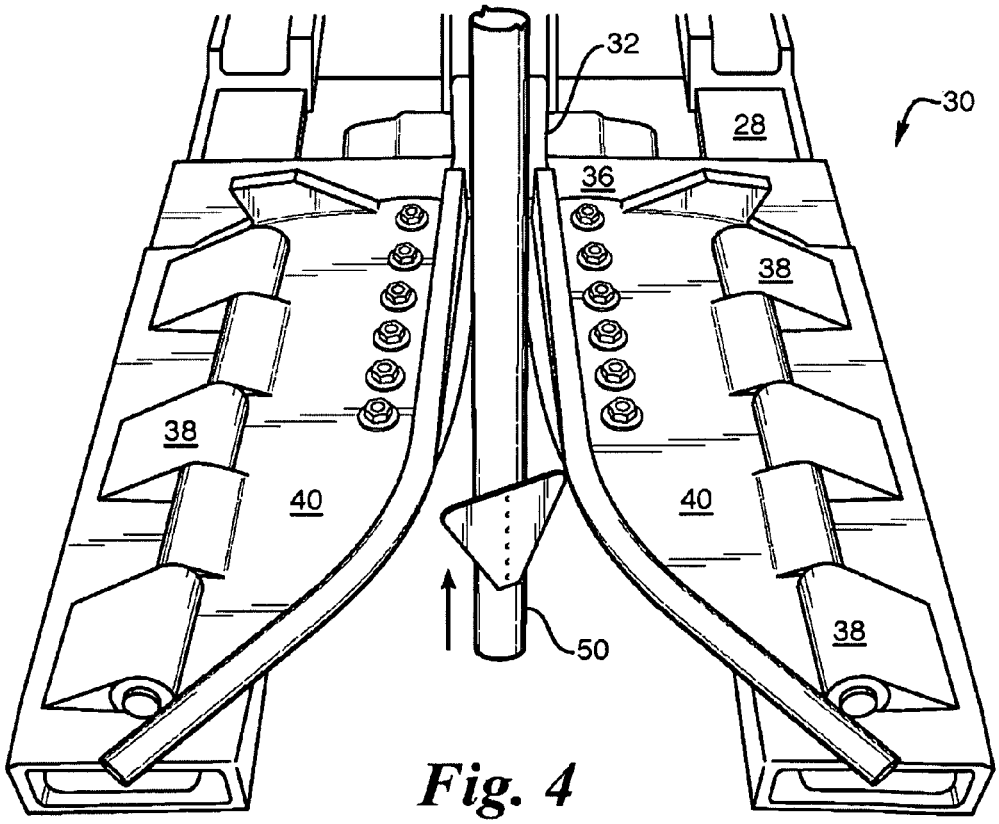
FIG. 4 shows a post puller in operation in an embodiment of the present invention.

With reference to FIGS. 3 and 4, the operation of post puller 30 in an embodiment of the present invention is shown. Upon discovery of a post, tree, or most any other object embedded in the ground, the operator could begin the post removal process 100 by coupling post puller 30 to vehicle 10 by simply driving up to post puller 30 and carefully inserting forks 28 into fork apertures 34 at state 102. The operator would then lift forks 28 and post puller 30 off the ground slightly to transport post puller 30 at state 104. The operator could then drive vehicle 10 over to post 50 placing post 50 directly in front of opening 44. The operator could then drive vehicle 10 forward allowing post 50 to enter opening 44 at state 106.

As post 50 moves towards blades 42 and begins to contact doors 40, doors 40 will move upward along butt hinges 38, thus allowing post 50 to travel back to blades 42. Butt hinges 38 allow small posts and large posts to enter into post puller 30 by rotating along hinge axis 48. Doors 40 can rotate 90° allowing very small to very large posts 50. Once post puller 30 is moved completely around post 50 and post 50 is engaged by blades 42, the operator can begin to lift forks 28 and thus post puller 30 at state 108. As post puller 30 elevates, blades 42 engage post 50 and pinch it between blades 42. The upward force of forks 28 places a large pinching force on post 50 and, thus, post 50 is held securely. The operator continues to elevate post puller 30 with post 50 until post 50 is pulled from the ground at state 110. The operator can then drive vehicle 10 to a desired location to drop off post 50 at state 112. Once at a drop site, the operator could simply move forks 28 downward at state 114. This action causes post 50 to lower until post 50 touches the ground. After this, the continued downward motion of post puller 30 causes doors 40 to move upward thus releasing post 50 at state 116. Post 50 will fall to the ground or the operator can slide post 50 out of post puller 30. The operator can now move to the next post for removal at state 118 repeating the prior steps as necessary.

Thus, embodiments of the POST PULLER are disclosed. One skilled in the art will appreciate the present teachings can be practiced with embodiments other than those disclosed. The disclosed embodiments are presented for purposes of illustration and not limitation, and the present teachings are limited only by the following claims.

I claim

1. A post puller attachment for a work vehicle, the work vehicle having a pair of pallet forks operatively coupled to hydraulically actuated lift arms, the post puller attachment comprising:

(a) a frame joining a pair of elongated, generally tubular, fork receiving members in parallel spaced relation corresponding to a spacing between the pair of pallet forks on the work vehicle;

(b) post removal doors connected by hinges to each of the tubular fork receiving members, the post removal doors extending toward one another in a space between the fork receiving members; and (c) a blade supported by each of the post removal doors adapted to engage and grip a post to be removed when the post removal doors straddle the post and the frame is elevated relative to ground.

2. The post puller attachment of claim 1 wherein the post removal doors taper inward from a leading end thereof toward the blade.

3. The post puller attachment of claim 1 wherein the hinges permit the post removal doors to pivot about generally horizontal axes.

4. The post puller attachment of claim 3 wherein the hinges permit the post removal doors to pivot through a range of up to about 90 degrees.

5. A post puller attachment for a work vehicle comprising:

a frame capable of being coupled to a work vehicle;

a first elongated fork tube for receiving within the first fork tube a first fork of the work vehicle and a second elongated fork tube for receiving within the second fork tube a second fork of the work vehicle, the first and second fork tubes joined to the frame in parallel, spaced-apart relation;

first and second post removal doors having an open side facing each other and an opposite end individually pivotally coupled to the first and second fork tubes, each door having a blade member affixed to extend beyond the open side; and a leading edge of the post removal doors being tapered to create a V-shaped opening when the post removal doors are each generally horizontally disposed.

6. The post puller attachment of claim 5 and further comprising hinges for coupling the post removal doors individually to the first and second fork tubes along hinge axes aligned with said fork tubes.

7. The post puller attachment of claim 5 wherein when a post to be pulled out of the ground is disposed between the blades of the first and second post removal doors and the frame is raised relative to the ground the post becomes firmly pinched between said blades.

8. The post puller attachment of any one of claims 1-4 wherein the tubular fork receiving members are of a rectangular cross-section.

9. The post puller attachment of any one of claims 5-7 wherein the first and second fork tubes have a rectangular cross-section.

* * * * *